United States Patent [19]

Perret et al.

[11] Patent Number: 4,817,757

[45] Date of Patent: Apr. 4, 1989

[54] WALL COVERING FOR ABSORBING SOUND WAVES IN A LIQUID MEDIUM

[75] Inventors: René Perret, Grenoble; Etienne Rouget de Gourcez, Fontainebleau, both of France

[73] Assignees: Alsthom, Paris; Vibrachoc, Evry, both of France

[21] Appl. No.: 195,227

[22] Filed: May 18, 1988

[30] Foreign Application Priority Data

May 25, 1987 [FR] France ..... 87 07317

[51] Int. Cl.[4] ..... E04B 1/82

[52] U.S. Cl. ..... 181/288; 181/286; 181/290; 181/294; 181/224

[58] Field of Search ..... 181/175, 224, 284, 286, 181/288, 190, 291, 193, 294, 30, 22, 227

[56] References Cited

U.S. PATENT DOCUMENTS

| | | | |
|---|---|---|---|
| 2,840,179 | 6/1958 | Junger | 181/286 |
| 2,960,175 | 11/1960 | McMillan | 181/198 |
| 3,985,198 | 10/1976 | Kurtze et al. | 181/286 |
| 4,560,028 | 12/1985 | Perret | 181/288 |

FOREIGN PATENT DOCUMENTS

| | | |
|---|---|---|
| 0161458 | 11/1985 | European Pat. Off. . |
| 2255313 | 7/1975 | France . |
| 2586849 | 3/1987 | France . |

*Primary Examiner*—B. R. Fuller

*Attorney, Agent, or Firm*—Sughrue, Mion, Zinn, Macpeak & Seas

[57] ABSTRACT

The covering is immersed in water (2). A viscoelastic substance (4) is disposed in ducts formed by rigid auxiliary walls (5) fixed to the base wall (1). The ends of these ducts (6) contain air. The invention is applicable, in particular, to providing protection against under-sea noise.

6 Claims, 1 Drawing Sheet

WALL COVERING FOR ABSORBING SOUND WAVES IN A LIQUID MEDIUM

The present invention relates to a wall covering for absorbing sound waves. When a source of noise and a body having rigid walls are placed in a fluid medium in which sound waves propagate, a portion of the energy conveyed by the waves and striking the wall is reflected by the wall, a portion is transmitted through the wall, and a small portion is absorbed by the material constituting the wall or its covering.

The value of the ratio of the absorbed energy to the incident energy, i.e. the absorption coefficient, is a function of the nature of the material constituting the wall covering, and also of the frequency of the sound.

BACKGROUND OF THE INVENTION

Several types of device are known for use in air for obtaining high absorption coefficients:

Porous materials having interstices in which the sound energy is transformed into heat by turbulance and friction within said interstices: when the incident wave arrives at the solid rigid portion of the wall it has lost its energy and reflection is very low.

Elastic panels constituting a spring-and-mass system: when the vibration period of this device is of the same order as that of the sound waves, a portion of the incident energy is transformed into mechanical energy and is then dissipated by deformation or internal friction.

Cavity resonators which also act as a spring-and-mass system in which the mass and the resilience belong to air: at resonance, a portion of the energy is dissipated by air headloss in the neck of the resonator.

In all these cases, the difficulty is obtaining effectiveness over a sufficiently wide frequency range:

The first type is effective only at high frequencies.

The drawback of the last two types is having their effectiveness limited to very narrow frequency bands centered on the natural frequencies of said systems.

In water, the same problem also arises: i.e. the problem of increasing the absorption coefficient of a wall:

This may be required either for the purpose of reducing the energy reflected from an underwater wall which is located in the proximity both of noise sources and of sound detectors. Such a wall may be a part, for example, of a dynamically positioned offshore drilling platform or oil exploration platform.

Another purpose may be to simulate wave propagation in an infinite medium within a noise-measuring laboratory.

An ideal covering would both:

prevent any reflection, even partial reflection, of the incident waves; and operate over a wide frequency band, and in particular, in water, over a band which includes low frequencies in the range 10 Hz to 1000 Hz.

Some prior coverings are quite inadequate when the ambient medium is constituted by a liquid and, in particular, at low frequencies below 1000 Hz.

That is why French patent document FR-A No. 2 562 699 and the corresponding documents EP-A No. 0161458 and U.S. Pat. No. 4,560,028 (Alsthom Atlantique F° 13666) propose a covering having the following features, some of which, at least for some of their functions, are common between this prior covering and a covering in accordance with the present invention.

This prior covering has a rear face for applying to a rigid base wall and a front face for being immersed in an ambient medium, in particular a liquid, through which sound waves are propagating. It comprises:

auxiliary walls fixed perpendicularly to the base wall and leaving elongate energy-dissipating ducts extending along a direction which is also perpendicular to said wall, said ducts being filled with a dissipating substance having a dynamic viscosity which is greater than that of the surrounding liquid so that the substance dissipates the energy by friction when it oscillates longitudinally in said ducts under the action of said sound waves; and a clearance space behind said dissipation ducts in order to allow the dissipating substance to perform such oscillations freely.

In this prior covering, said dissipating substance is a mixture of liquids and said clearance space is occupied by flexible enclosures inflated with a gas whose elasticity makes possible and conditions the oscillations of said liquid. The liquid must be separated from the ambient fluid by a membrane which must be both transparent to the sound waves to be damped and sufficiently strong to avoid being damaged in operation. Providing such a membrane can sometimes be problematical.

The object of the present invention is to provide effective absorption of sound waves in a liquid ambient medium, even when at low frequencies, by means of a covering which is more robust and easy to manufacture.

SUMMARY OF THE INVENTION

The present invention provides a covering which has the above-specified common features, said covering being including the improvement whereby said dissipating substance is a viscoelastic substance which responds to stress by considerable deformation accompanied by viscous friction, and which responds to such stress ceasing by spontaneously and progressively returning to its initial shape, said substance adherring to said fixed auxiliary walls such that its elasticity ensures that it returns into position after longitudinal displacement.

In accordance with the invention, it is further preferable to adopt the following additional features.

When the covering is intended for absorbing waves of frequency f (units: $s^{-1}$) the expression:

$$32 \times G' \times \tan A \times l/D^2 \times 6.283 \times f \times p_o \times C_o$$

has a value lying between about 0.2 and 5, where:

G' is the shear modulus of said viscoelastic substance (units: $N.m^{-2}$);

tan A is the tangent of its loss angle, i.e. the ratio between the viscous and the elastic components of said modulus;

l is the length of said ducts occupied by said substance, i.e. the thickness thereof (units: m);

d is the equivalent hydraulic diameter of said ducts (units: m);

$p_o$ is the density of said ambient liquid (units: $kg.m^{-3}$); and $C_o$ is the speed of sound waves in said liquid (units: $m.s^{-1}$);

that said dissipating substance contains a mixture of an elastomer and a powder filler, and said clearance space contains a gas;

that said auxiliary walls extend through the thickness of said dissipating substance and through the thickness of said clearance space up to said base wall to which they are fixed, thereby fixing the covering assembly;

that said auxiliary walls form sealed compartments for said gas in said clearance space; and that said gas is enclosed in said clearance space at a pressure suitable for preventing said dissipating substance from being excessively deformed by the hydrostatic pressure of the ambient water, when in use.

It should be understood that adjacent dissipation ducts cannot be completely separated from one another by the auxiliary walls. The important point, in accordance with the invention, is that zones, the ducts, exist in which the dissipating substance is free to deform in practice under the influence of sound waves, together with rigid elements which, by adherence, cancel the displacement of said substance in contact therewith.

The equivalent hydraulic diameter d is equal to the diameter of the ducts if they are circular in section. If their section is a different regular shape, the equivalent hydraulic diameter may be defined as being equal to four times the ratio of the area of the right cross-section of the duct to the wetted perimeter.

For irregular shapes, the above wetted perimeter is the length in each right cross-section of the line which constitutes the boundary between the stationary zone and the zone in which limited displacement of the substance is possible, said displacement increasing with increasing distance from the nearest boundary line.

In water, the wave frequencies to be absorbed extend over a wide spectrum and often fall below about 1000 Hz.

Implementations of the invention are described in greater detail below with reference to the accompanying diagrammatic figures. It should be understood that the features described above as being preferred features are adopted in these examples and that the items described and shown may, without going beyond the scope of the invention, be replaced by other items providing the same technical functions. When the same item is shown in several figures, it is designated in each of them by the same reference symbol.

BRIEF DESCRIPTION OF THE DRAWING

Embodiments of the invention are described by way of example with reference to the accompanying drawing, in which.

MORE DETAILED DESCRIPTION

These figures show embodiments of devices for absorbing low frequency sounds propagating in water.

Figure 1:
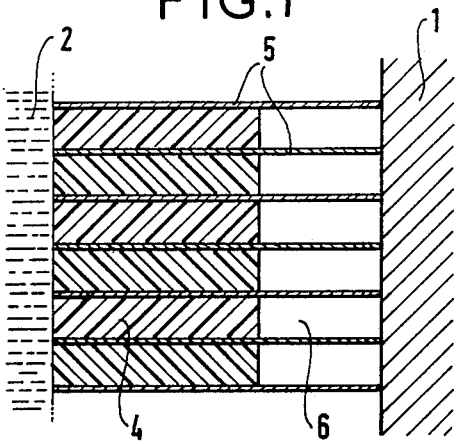
FIG. 1 shows a first covering in accordance with the invention in section on a plane perpendicular to the base wall.

As shown in FIG. 1, an absorbent covering is placed against a base wall 1 which is rigid and immersed in an ambient medium constituted by water 2. The absorbent covering comprises the following items which follow one another in the water-to-water wall direction:

a metal honeycomb 5 constituting the dissipation ducts 4; said ducts being about 100 mm long, having a hexagonal section with an area of about 1 $cm^2$ and they are filled with a visco-elastic material designated by the same reference numeral 4 and constituted, for example, by one of the following mixtures:

| | Mixture 1 | Mixture 2 | Mixture 3 |
|---|---|---|---|
| Polyisoprene 100 | 100 | — | 50 |
| Polyisoprene 2000 | — | 100 | 50 |
| Zinc oxide | 5 | 5 | 5 |
| Steric acid | 3 | 3 | 3 |
| Anti-oxygen | 2 | 2 | 2 |
| Carbon black | 50 | 50 | 50 |
| Paraffin oil | 5 | 5 | 5 |
| Sulfur | 3.5 | 3.5 | 3.5 |
| CBS | 0.7 | 0.7 | 0.7 |

Polyisoprene 100 and polyisoprene 2000 are defined in French patent publication FR-A No. 2 255 313 (GOLE). C B S means cyclohexyl benzothiazole sulfonamide.

The honeycomb 5 continues behind said material up to the base wall 1 over a width of 60 mm, for example, in order to form compartments 6 which are filled with air at two or three bars and which constitute said clearance space.

Figure 2:
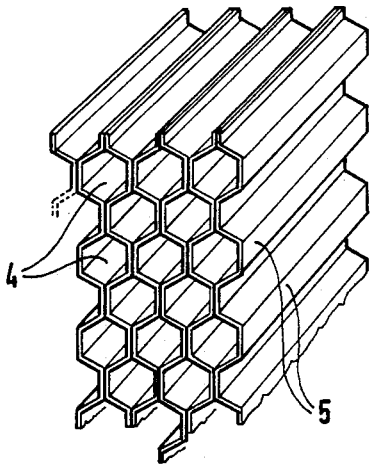
FIG. 2 shows the auxiliary walls of this covering in perspective and on a larger scale.

In a variant, the metal honeycomb shown in FIG. 2 is replaced by embossed paper covered in resin and stuck together to delimit energy-dissipating ducts.

Figure 3:
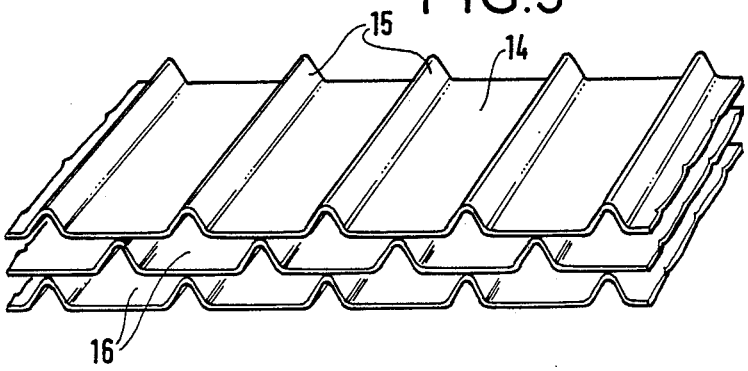
FIG. 3 is a view showing the auxiliary walls of a second covering, in perspective and on a larger scale.

In FIG. 3, the ducts containing the dissipating substance are substantially rectangular in section and are constituted by stacking ribbed plates 14. The ribs 15 of these plates have a height of about 5 mm and between them they delimit ducts 16.

Figure 4:
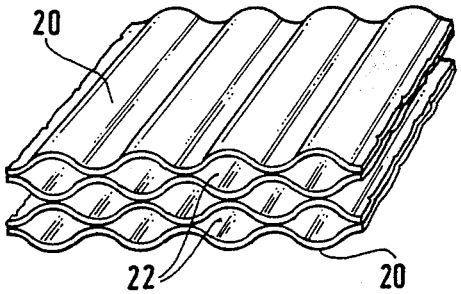
FIG. 4 shows the auxiliary walls of a third covering, in perspective and on a larger scale.

In FIG. 4, the auxiliary walls are in the form of superposed corrugated sheets such as 20 which form ducts such as 22 between one another.

We claim:

1. A wall covering for absorbing sound waves in a liquid medium, said covering having a rear face for applying to a rigid base wall and a front face for being immersed in an ambient medium, in particular a liquid, through which sound waves propagate, said covering comprising:

auxiliary walls fixed perpendicularly to the base wall and leaving elongate energy-dissipating ducts extending along a direction which is also perpendicular to said wall, said ducts being filled with a dissipating substance having a dynamic viscosity which is greater than that of the surrounding liquid so that the substance dissipates the energy by friction when said substance oscillates longitudinally in said ducts by the propagation of said sound waves; and a clearance space behind said dissipation ducts in order to allow the dissipating substance to perform such oscillations freely;

wherein said dissipating substance is a visco-elastic substance which responds to stress by considerable deformation accompanied by viscous friction, and which responds to such stress ceasing by spontaneously and progressively returning to an initial shape thereof, said substance adherring to said fixed auxiliary walls such that the elasticity of said substance ensures that the substance returns to said initial shape after longitudinal displacement.

2. A covering according to claim 1, for absorbing waves of frequency f, and wherein the expression:

$$32 \times G' \times \tan A \times l/D^2 \times 6.283 \times f \times p_O \times C_O$$

has a value lying between about 0.2 and 5, where:

G′ is a shear modulus of said viscoelastic substance (units: $N.m^{-2}$);

tan A is a tangent of a loss angle, i.e. the ratio between the viscous and the elastic components of said modulus;

l is a length of said ducts occupied by said substance, i.e. a thickness thereof (units: m);

d is an equivalent hydraulic diameter of said ducts (units: m);

$p_O$ is the density of said ambient liquid; (units: $kg.m^{-3}$); and $C_O$ is the speed of sound waves in said liquid (units: $m.s^{-1}$).

3. A covering according to claim 1, wherein said dissipating substance contains a mixture of an elastomer and a powder filler, and said clearance space contains a gas.

4. A covering according to claim 3, wherein said auxiliary walls extend through the dissipating substance and through the thickness of said clearance space up to said base wall, thereby fixing the covering assembly.

5. A covering according to claim 4, wherein said auxiliary walls form sealed compartments for said gas in said clearance space.

6. A covering according to claim 5, wherein said gas is enclosed in said clearance space at a pressure suitable for preventing said dissipating substance from being excessively deformed by pressure of the ambient medium, when in use.

* * * * *